US005887019A

United States Patent [19]

Swanger

[11] Patent Number: 5,887,019

[45] Date of Patent: Mar. 23, 1999

[54] METHODS AND APPARATUS FOR SECURING INDUCTION COILS WITHIN AN INDUCTION COIL MODULE

[75] Inventor: W. Shane Swanger, Pleasant Grove, Utah

[73] Assignee: Geneva Steel, Provo, Utah

[21] Appl. No.: 31,497

[22] Filed: Feb. 26, 1998

Related U.S. Application Data

[60] Provisional application No. 60/035,354 Feb. 26, 1997.

[51] Int. Cl.[6] ..... H05B 6/22

[52] U.S. Cl. ..... 373/153; 373/151

[58] Field of Search ..... 373/153, 151

[56] References Cited

U.S. PATENT DOCUMENTS

| | | | |
|---|---|---|---|
| 1,810,820 | 6/1931 | Davis et al. | 373/153 |
| 1,811,213 | 6/1931 | Rohn | 373/153 |
| 2,914,593 | 11/1959 | Kann | 373/153 |
| 5,179,258 | 1/1993 | Arvedi et al. | 219/10.61 R |
| 5,578,233 | 11/1996 | Arvedi et al. | 219/645 |

FOREIGN PATENT DOCUMENTS

| | | | |
|---|---|---|---|
| 501903 | 9/1938 | United Kingdom | 373/151 |

*Primary Examiner*—Teresa Walberg
*Assistant Examiner*—Quang Van
*Attorney, Agent, or Firm*—Madson & Metcalf

[57] ABSTRACT

Methods and apparatus for securing induction coils within an induction coil module including a plurality of flexible connectors having a first end, a second end, and a length disposed between the first and second ends. A first attachment member is securely attached to the first end of the flexible connector and pivotably connected to a support assembly. A second attachment member is securely attached to the second end of the flexible connector 16. The second attachment member having an induction coil attached thereto. Correspondingly, the pivotal engagement of the flexible connectors in relation to the support assembly of the induction coil module facilitates a means for allowing the flexible connectors and their attached induction coils to move both horizontally and vertically in relation to the support assembly, thus dramatically reducing the potential for structural fatigue and stress fracturing of the various mechanical connections of an induction furnace.

18 Claims, 6 Drawing Sheets

METHODS AND APPARATUS FOR SECURING INDUCTION COILS WITHIN AN INDUCTION COIL MODULE

BACKGROUND OF THE INVENTION

1. Related Application

This application claims the benefit of U.S. Provisional Application Ser. No. 60/035,354, filed on Feb. 26, 1997, for Apparatus for Securing Induction Coils Within an Induction Coil Module.

2. Field of the Invention

The present invention is related to methods and apparatus for suspending induction coils within induction coil modules in an induction furnace. More particularly, the present invention is related to methods and apparatus including flexible connectors used to suspend induction coils and connect them to a support bar within the induction coil module.

3. Technical Background

Steel has been part of some of the greatest achievements in history: it was the "iron horse" and rails that helped create a nation out of frontiers; it is the backbone of bridges, the skeleton of skyscrapers, the framework of our automobiles and appliances. It is the high-strength, better-than-plastic frames for eyeglasses; it is the stronger, more affordable, more-resilient-than-wood frame in new housing; it is the high-tech alloy used in the Space Shuttle's solid fuel rocket motor cases; and it is the coated, precision surgical instruments used in hospital operating rooms around the world. The production and processing of steel has become a core industry that in the last two decades has revolutionized its manufacturing processes, transformed its workforce, and collaborated with customers around the world to make stronger, lighter, more versatile steel at a lower cost to the consumer.

Consequently, new and emerging technologies for processing steel are being developed by those skilled in the art. For example, induction furnaces are being used to heat slabs, plates, or ingots of steel by introducing an electrical current that is caused to flow through the steel by means of electromagnetic induction. In operation, an induction furnace may receive a steel slab, plate, or ingot and thereby increase the average temperature of the slab, plate, or ingot up to and beyond melting point. After passing the slab, plate, or ingot through various environments of extreme heat as provided by several induction furnaces, the slab, plate, or ingot may be sent to a rolling mill for further processing.

As appreciated in the art, slabs, plates, or ingots of steel are generally moved along aisles of rollers and may be passed through one or more induction furnaces. The induction furnaces of the prior typically comprise a plurality of induction coils rigidly mounted to a housing frame of the furnace. Functionally, the induction coils provide a means for obtaining intermittent high voltage by way of high capacity electrical connectors and induce electrical currents into the steel slab, plate, or ingot to generate extremely high elevated temperatures. Because of the high density electromagnetic field created by the induction coils, there are considerable attraction and repulsion forces acting between each induction coil and the connection mechanisms attaching each induction coil to the furnace housing, thus resulting in substantial vibrations in the mechanical connectors of the induction furnace.

A significant disadvantage with induction furnaces of the prior art, however, is their tendency to experience comprehensive structural failure as a result of the vibrations caused by the cycling of electrical current through the induction coils during the heating process. Accordingly, the mechanical and structural connection mechanisms of prior art induction furnaces traditionally encounter severe stress fracturing and breakage. The investigation and study of failed connections has revealed that stress fractures have the potential of occurring everywhere there is a bolted or rigid connection, inclusive of the support rods and the fastener assembly securing the support rods to the induction coils. Because the connection mechanisms between the induction coils and the furnace housing are typically covered with massive layers of insulation and protective coatings, it is generally difficult to detect or even predict potential mechanical failures in the connections before they happen.

When an induction furnace fails, it generally results in significant down time of the furnace as well as the casting and/or roll lines. A maintenance team consisting of numerous engineers and skilled technicians is typically required to remove the induction furnace from the steel processing line and begin immediately rebuilding the unit. The down time for servicing and rebuilding an induction furnace module may be on the average a period of approximately two weeks. If the maintenance team works around the clock, an induction furnace may potentially be up and running within a week. Besides the time and energy involved in making the repairs to the mechanical connections of the induction furnaces, the cost for maintenance, repairs, and replacement parts can be a significant investment on the part of the steel mill, especially in view of the structural failures that are consistently encountered by prior art induction furnaces.

In an effort to reduce the structural fatigue and stress fracturing of the various mechanical connections of prior art induction furnaces, various remedies have been developed with little appreciable improvement. For example, heavier fasteners, different grades of steel support rods, and varying the electrical current and the on and off cycles of the coils have been undertaken. In addition, those skilled in the art incorporated a spring mounting mechanism in relation to the rigid structural rods attached to the furnace housing in an attempt to keep constant pull-back force on the rods.

While the foregoing prior art remedies have had little impact in reducing the number of induction coil failures, those skilled in the art developed induction furnace modules which replace the rigid structural rods with flexible mounting members that function to secure the support bar to the furnace housing. In structural design, the prior art flexible mounting member consists of a steel cable disposed between the furnace housing and the support bar having several induction coils rigidly attached thereto. The inclusion of flexible mounting members between the furnace housing and the support bar helps to alleviate some of the vibrational energy of the induction furnace, however, these prior art flexible mounting members have only seemingly delayed the imminent structural failure of the connection mechanisms of the induction furnace.

Thus, it would be an advancement in the art to provide improved methods and apparatus for attaching induction coils within induction coil modules. It would also be an advancement in the art to improve the overall attachment mechanisms used in induction furnaces.

Such methods and apparatus are disclosed and claimed herein.

BRIEF SUMMARY AND OBJECTS OF THE INVENTION

In view of the foregoing, it is a primary object of the present invention to provide novel induction coil module securing apparatus comprising a plurality of flexible connectors pivotably disposed in relation to one or more support bars, each flexible connector having an induction coil securely attached thereto.

It is also an object of the present invention to provide a suspension assembly comprising at least one attachment member pivotably disposed between a furnace housing and a support bar. The support bar further having a plurality of flexible connectors pivotably connected thereto. In operation, the suspension assembly of the present invention facilitates the horizontal and vertical movement of the structural connection mechanisms of the present invention (e.g., the flexible connectors and/or pivotably disposed attachment members), thereby significantly reducing the potential for structural fatigue and stress fracturing which is normally caused as a result of vibrations created within the induction coil module during the heating process.

It is a further object of the present invention to provide an induction coil securing apparatus which can be incorporated into various applications in relation to steel mill rolling processes and for the improvement of casting quality and finishing gauges of steel slabs, plates, or ingots. For example, the suspension assembly of the present invention may be incorporated within transfer bar heaters and other similar heating devices known in the art.

It is a still further object of the present invention to provide an induction coil securing apparatus which significantly reduces the operational downtime, maintenance, and repair costs generally associated with rebuilding induction furnaces and replacing various damaged mechanical connectors. As will be appreciated in this particular art, economic considerations are significant when dealing with the highly competitive steel industry, since mill downtime for the purpose of maintenance and repairs is frequently found to be commercially impractical. Accordingly, even a slight savings in the maintenance and repair costs may substantially enhance the commercial appeal of a particular component or assembly when considering issues of mass production capability.

Consistent with the foregoing objects, and in accordance with the invention as embodied and broadly described herein, the present invention relates to improved methods and apparatus for attaching induction coils within an induction coil module. In particular, the present invention relates to the use of flexible connectors for connecting the induction coils to a support bar. The support bar is in turn attached to the induction furnace housing.

The present invention teaches a flexible connector comprising a length of steel cable or other flexible material. In one embodiment, the cable includes a swedged threaded rod at one end and a swedged clevis at the opposite end. The threaded rod connects the flexible connector to individual induction coils. The clevis is in turn connected to a support bar to form an induction furnace module. The support bar is then attached to the furnace housing by suitable attachment means.

Using the flexible cable to attach the induction coils to the support bar provides significant vibration dampening. The induction coils can move and vibrate normally without causing damage to the flexible connectors. Thus, the present invention provides a significant improvement over conventional attachment means.

These and other objects and advantages of the invention will become apparent upon reference to the accompanying drawings.

BRIEF DESCRIPTION OF THE DRAWINGS

In order to more fully understand the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DESCRIPTION OF THE PREFERRED EMBODIMENT

Figure 1:
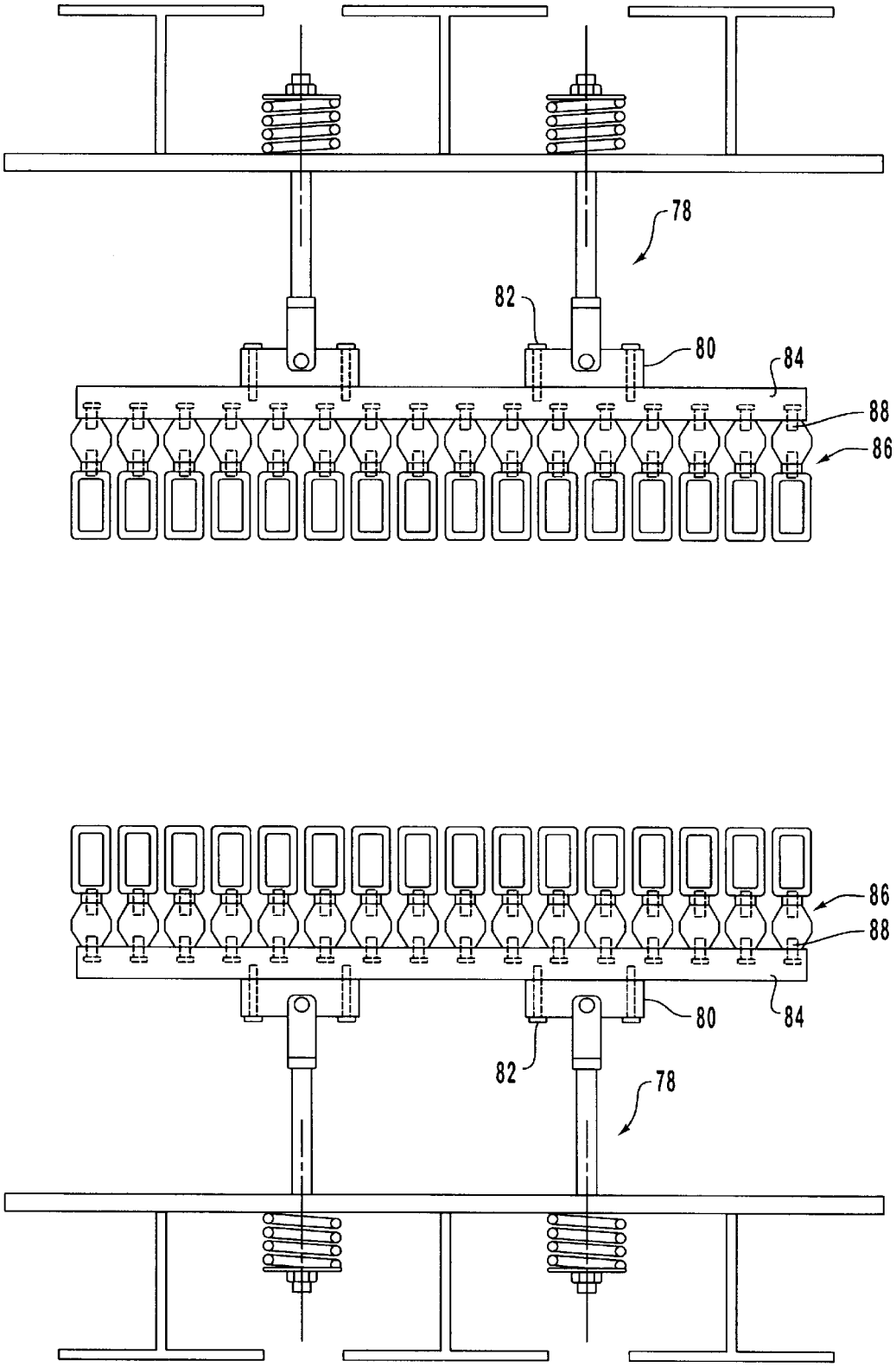
FIG. 1 (PRIOR ART)
FIG. 1 is a drawing of an existing prior art design showing the manner in which induction coils are formed into an induction coil module and the module is in turn attached to the furnace housing.

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 2 through 6, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

One presently preferred embodiment of the present invention, designated generally at 10, is best illustrated in FIGS. 2, 3, 4, and 5. As shown, an induction coil module securing apparatus 10 comprises a plurality of flexible connectors 16 disposed in relation to a support assembly 11. Each of the flexible connector 16 having a first end 26, a second end 28, and a length disposed between the first and second ends 26, 28. A first attachment member 20 is securely attached to the first end 26 of the flexible connector 16 and pivotably connected to the support assembly 11. A second attachment member 18 is securely attached to the second end 28 of the flexible connector 16. The second attachment member 18 is preferably connected to an induction coil 24. Correspondingly, the pivotal engagement of the flexible connectors 16 in relation to the support assembly 11 facilitates a means for allowing the flexible connectors 16 and their attached induction coils 24 to move both horizontally and vertically in relation to the support assembly 11, thereby dramatically reducing the potential of structural fatigue and stress fracturing of the mechanical connectors of the induction coil module securing apparatus 10 of the present invention.

Figure 3:
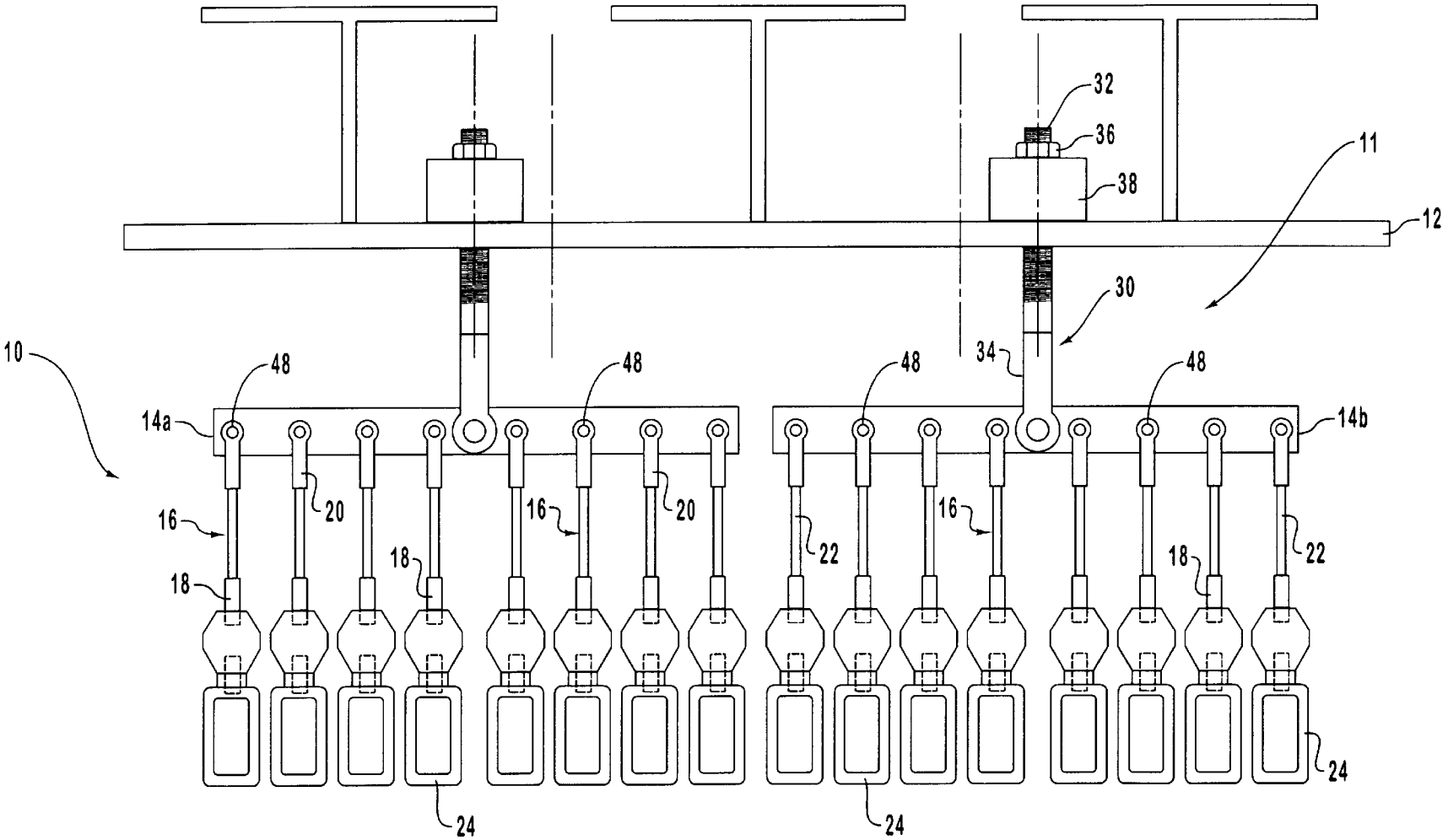
FIG. 3 is a plan view illustrating one presently preferred embodiment of a suspension assembly of the present invention.
Figure 4:
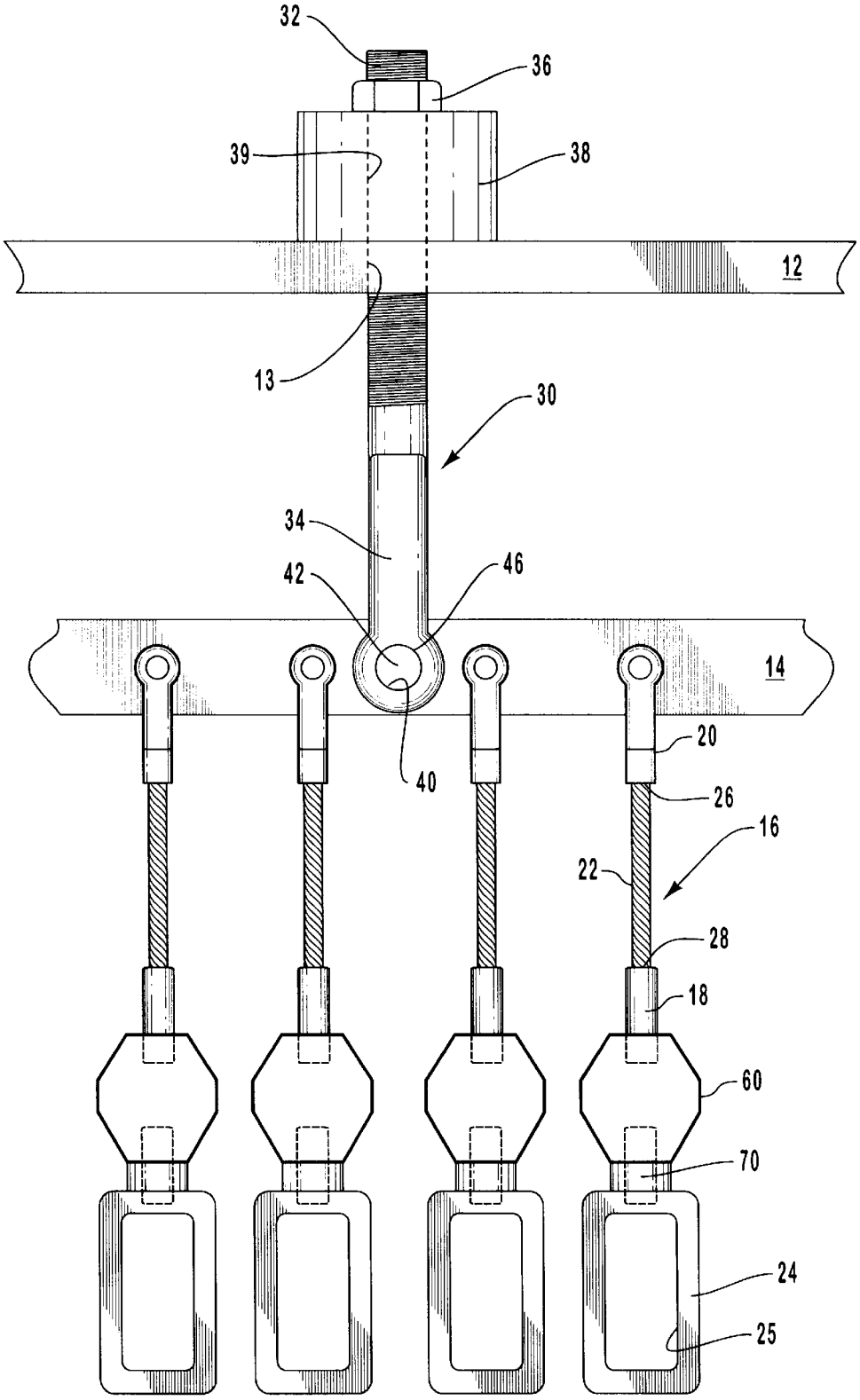
FIG. 4 is a plan view of one presently preferred embodiment of an attachment member of the present invention pivotably disposed in relation to a support bar and attached at an opposing end to the furnace housing.

Structurally supporting the flexible connectors 16 of one presently preferred embodiment of the present invention, the support assembly 11 comprises an attachment member 30 pivotably disposed between at least one support bar 14 and a furnace housing 12. As best shown in FIGS. 3 and 4, the attachment member 30 comprises a threaded end 32 which may be introduced into the internal periphery of a mounting aperture 13 formed in the furnace housing 12. To secure the engagement between the attachment member 30 and the furnace housing 12, a locking nut 36 is rotatably disposed in relation to the threaded end 32 of the attachment member 30.

An elastomeric member 38 may also be disposed in relation to the threaded end 32 of the attachment member 30. In one presently preferred embodiment, the elastomeric member 38 comprises an elastomeric washer. In preferred construction, the elastomeric member 38 includes an internal channel 39 wherein a leading portion of the threaded end 32 of the attachment member 30 may be introduced and retained in relation thereto by means of the rotatable relationship of the locking nut 36. As will be appreciated by those skilled in the art, a coil spring may be disposed in relation to the threaded end 32 of the attachment member 30, thereby providing an alternate means for reducing vibrations in the support assembly 11.

Figure 6:
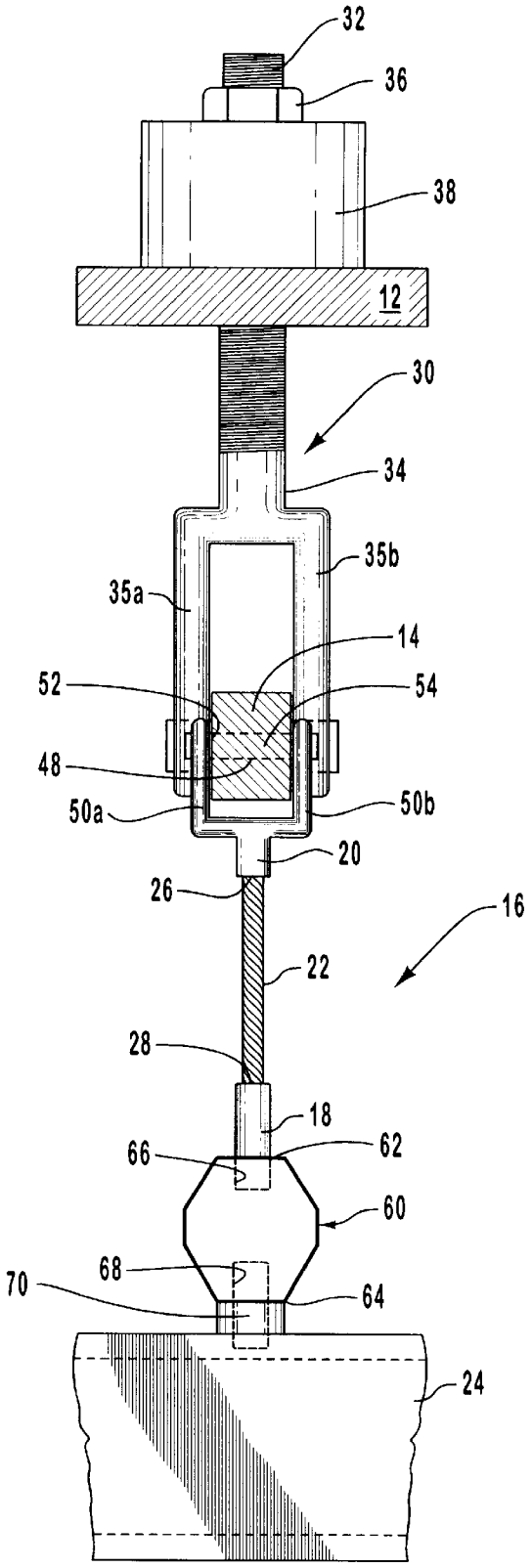
FIG. 6 is a side view of the flexible connector showing the opposing engagement arms of the swedged clevis pivotably engaging the support bar and the opposing engagement arms of the attachment clevis of the attachment member pivotably engaging the support bar, as taken along lines 6—6 of FIG. 5.

As best illustrated in FIGS. 3, 4, and 6, engageably disposed in relation to the opposing end of the attachment member 30 is an attachment clevis 34 having two opposing engagement arms 35*a*, 35*b*. The attachment clevis 34 comprises a general U-shaped configuration wherein the opposing engagement arms 35*a*, 35*b* are disposed parallel and in spaced apart relation to opposite sides of the support bar 14. In particular, a corresponding through-bore 42 is formed in each of the opposing engagement arms 35*a*, 35*b*. The through-bore 40 is formed having an internal periphery sufficient for receiving a pivot pin 42 (or bolt). In operation, the introduction of the pivot pin 42 within the internal periphery of the through-bore 40 of the engagement arms 35*a*, 35*b* of the attachment clevis 34 and then into a receiving aperture 46 formed in the support bar 14 facilitates a pivotal engagement between the attachment clevis 34 of the attachment member 30 and the support bar 14. In this regard, the pivotal relationship of the attachment member 30 in relation to the support bar 14 allows for horizontal movement of the support bar 14 in relation to the furnace housing 12 of the induction furnace.

Referring now to the prior art induction furnace as illustrated in FIG. 1, an attachment member 78 is shown attached to a mounting block 80 which is rigidly connected to a support bar 84 by means of a bolted assembly 82. Although one end of the attachment member 78 may be pivotably connected to the mounting block 80 of the prior art support assembly, the structural engagement of the bolted assembly 82 in relation to the support bar 84 has proven to often result in mechanical failure and structural fracturing under the intense vibrational forces created by the induction coils 86 rigidly attached directly to the support bar 84 by means of bolted fasteners 88.

Figure 2:
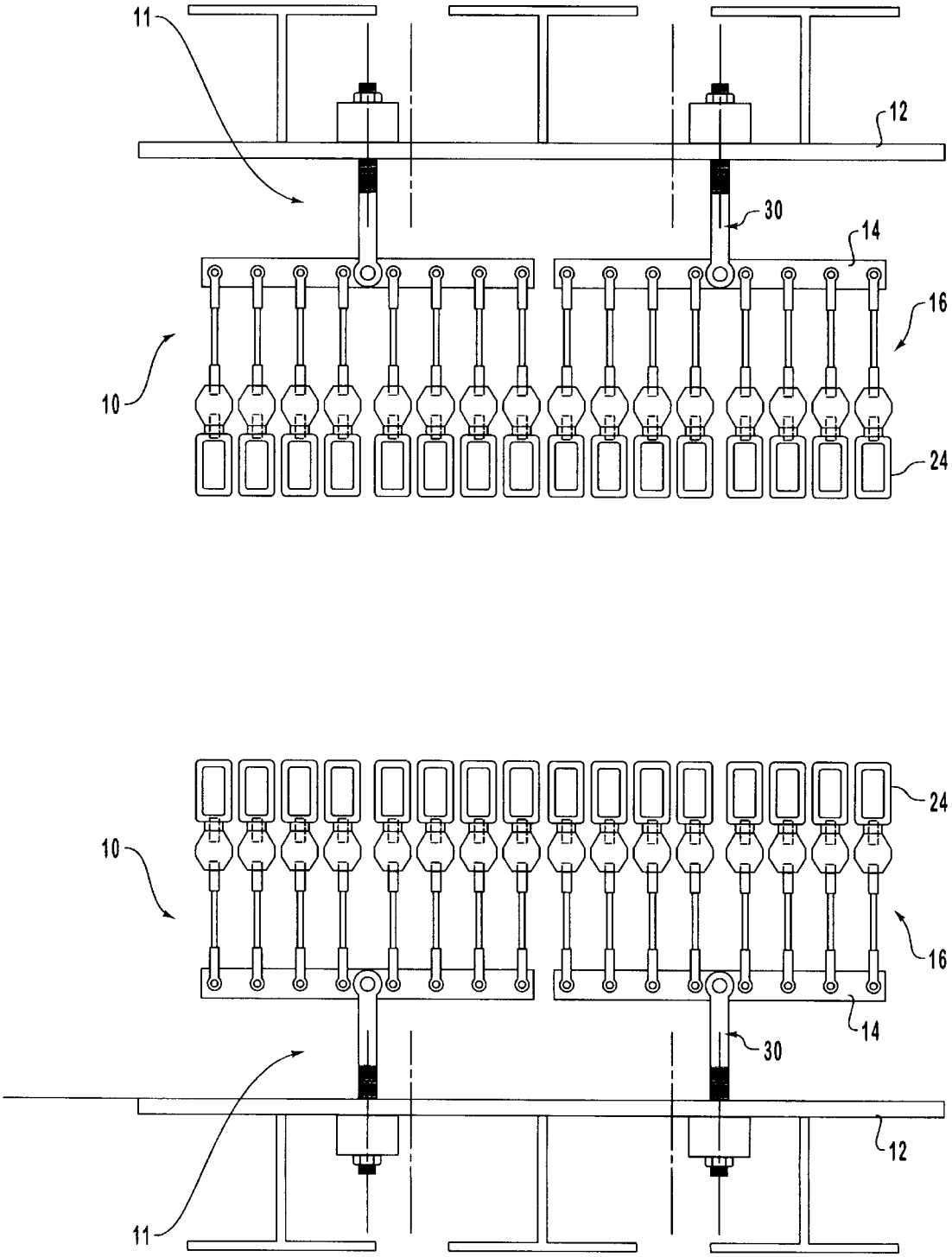
FIG. 2 is a drawing illustrating the methods and apparatus of the present invention including particularly the flexible connectors for attachment to the individual induction coils.

Based on the foregoing, one of the major advancements in the art as realized by the present invention over prior art induction furnaces is the incorporation of a flexible connector 16 disposed between the support bar 14 and the induction coil module 24. In one presently preferred embodiment of the present invention, a plurality of flexible connectors 16 are pivotably disposed in relation to at least one support bar 14, as best illustrated in FIGS. 2, 3 and 4. Referring specifically to FIG. 4, each of the flexible connectors 16 comprises a first end 26, a second end 28, and a length disposed between the first and second ends 26, 28. The length of the flexible connector 16 preferably includes a flexible cable 22 formed of a substantially sturdy material having sufficient tensile strength. In one presently preferred embodiment of the present invention, the flexible cable 22 consists of a steel cable or wire rope. As will be readily appreciated by those skilled in the art, other suitable flexible members are possible which are consistent with the spirit and scope of the present invention.

Securely attached to the first end 26 of the flexible connector 16 is a first attachment member 20. Preferably, the first attachment member 20 comprises a clevis having a general U-shaped configuration that is attached by means of being swedged to the first end 26 of the flexible connector. The swedged clevis 20 is preferably secured to the support bar 14 by means of a pivotal engagement. Referring now to FIG. 6, the clevis 20 comprises two opposing engagement arms 50*a*, 50*b* that are disposed parallel and in spaced apart relation to each other. The engagement arms 50*a*, 50*b* of the clevis 20 are selectively disposed to provide a means for engaging the opposing sides of the support bar 14, thus facilitating a pivotal engagement therebetween.

In structural design, a through-bore 52 is correspondingly formed in each of the opposing engagement arms 50*a*, 50*b* which comprises an internal periphery sufficient for receiving a pivot pin 54 (or bolt). In operation, the introduction of the pivot pin 54 within the internal periphery of the through-bore 52 of the swedged clevis 20 of the flexible connector 16 and then into an opening 48 formed in the support bar 14 enables a pivotal engagement between the flexible connector 16 and the support bar 14. This pivotal engagement between the flexible connector 16 and the support bar 14 facilitates horizontal and vertical movement of the flexible connectors 16 and attached induction coils 24 in relation to the support assembly 11. In particular function, the horizontal and vertical movement of the flexible connectors 16 and their attached induction coils 24 dramatically reduces the potential of structural fatigue and stress fracturing of the mechanical connectors of the induction coil module securing apparatus 10 of the present invention.

As shown in FIGS. 2 and 3, the support bar 14 may include at least two support bars 14*a*, 14*b* which are disposed longitudinally in an end-to-end relationship. The two support bars 14*a*, 14*b*, as contemplated herein, may be used to replace the single support bar 84 as provided in the prior art induction furnace illustrated in FIG. 1. In preferred design, each support bar 14*a*, 14*b* includes the functional capability of being able to move horizontally independent of the other support bar. In this regard, each support bar 14*a*, 14*b* may be pivotably suspended in relation to the furnace housing 12 by means of at least one independent attachment member 30.

Preferably, the support bars 14*a*, 14*b* are formed of a substantially sturdy material having sufficient structural integrity to retain a plurality of flexible connectors 16 and their attached induction coils 24 in a suspended engagement thereto. In one presently preferred embodiment of the present invention, the support bars 14*a*, 14*b* are formed of carbon steel. It will be readily appreciated by those skilled in the art, however, that a wide variety of suitable metals or other materials are possible which are consistent with the spirit and scope of the present invention.

As contemplated herein, the independent pivotal engagement of the support bars 14*a*, 14*b* in relation to the furnace housing 12 facilitates additional means for dampening the vibrations of the induction coil module securing apparatus 10 during the heating process. Similarly, the independent pivotal engagement of the support bars 14*a*, 14*b* assists in the reduction of the fracture potential of the structural connections of the present invention and provides an even force on all coil turns as well as facilitating means for breaking the current loop potential. It will be appreciated, however, that the incorporation of at least two independent support bars 14*a*, 14*b* in relation to the support assembly 11 of an induction coil module is not critical to the invention. Moreover, a single support bar may be used to suspend a plurality of flexible connectors 16 and their attached induction coils 24 in pivotal relationship thereto which is herein contemplated by the present invention.

In one presently preferred embodiment of the present invention, each support bar 14*a*, 14*b* of the support assembly 11 comprises a general linear length of between approximately 30 cm and 60 cm, and preferably about 46.25 cm. As discussed above, each support bar 14*a*, 14*b* includes a plurality of openings 48 formed in spaced apart relationship along the linear length of the support bar. Each of these openings 48 formed in the support bars 14 facilitates the introduction of a pivot pin 54, thereby providing a pivotal engagement with the swedged clevis 20 of a flexible connector 16.

As illustrated in FIG. 3, eight openings 48 may be formed in each support bar 14*a*, 14*b* for pivotably engaging at least eight independent flexible connectors 16. In one presently preferred embodiment of the present invention, the openings formed in the support bars 14*a*, 14*b* are generally disposed at a spaced apart distance of between approximately 5 cm and 7 cm, and preferably about 6 cm. As will be appreciated by those skilled in the art, since the induction coil module securing apparatus 10 of the present invention must conform to the size and dimension of an induction coil furnace to which it is to be applied, it is anticipated that the various structural elements thereof be formed in a series of different sizes to accommodate different uses. It is intended, therefore, that the examples provided herein be viewed as exemplary of the principles of the present invention, and not as restrictive to any particular structure or dimensional sizes or shape limitations for implementing those principles.

Figure 5:
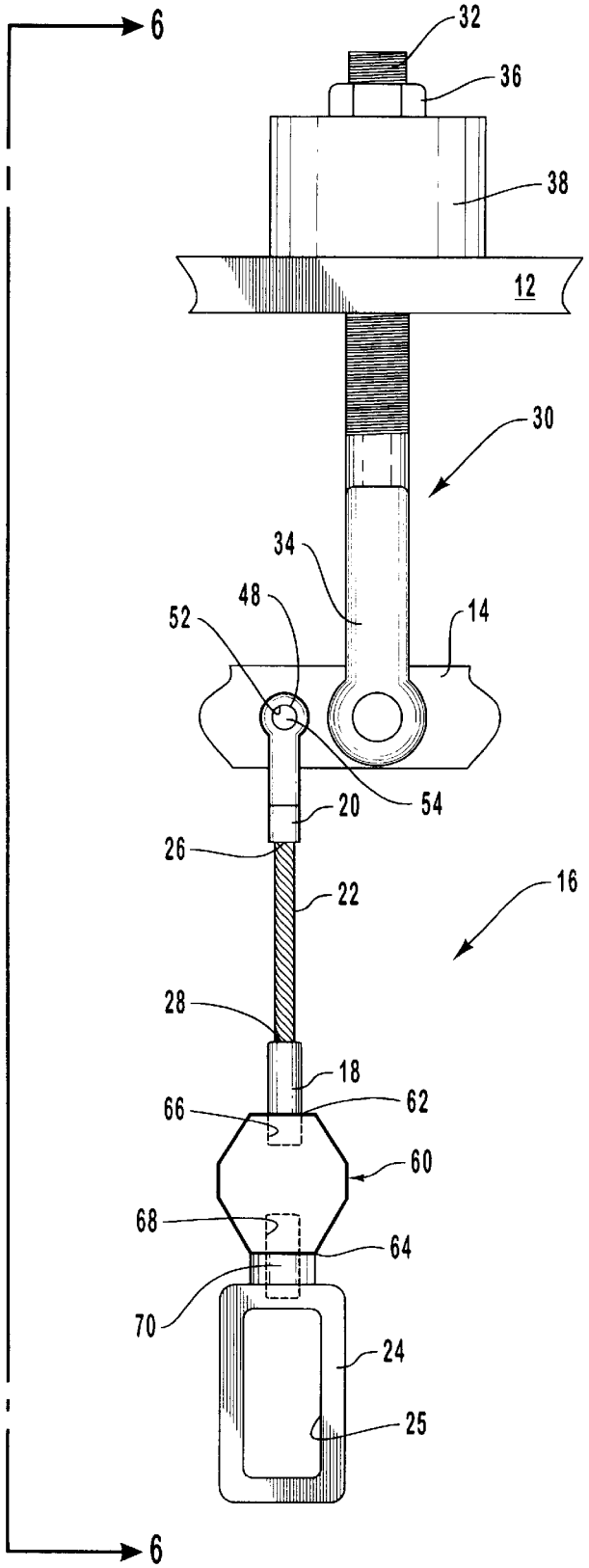
FIG. 5 is a plan view of one presently preferred embodiment of a flexible connector of the present invention pivotably disposed in relation to the support bar, the flexible connector having an opposing end engageably attached to an induction coil.

Referring now to FIGS. 4, 5, and 6, securely attached to the second end 28 of the cable 22 of the flexible connector 16 is a second attachment member 18. In one presently preferred embodiment, the second attachment member 18 comprises a threaded rod secured to the second end 28 of the flexible cable 22 by means of a swedged engagement. Functionally, the swedged threaded rod 18 of the flexible connector 16 is rotatably introduced into the internal periphery of a receiving hole 66 formed at the first end 62 of an insulator 60. By threadably engaging the receiving hole 66 of the insulator 60, the threaded rod 18 secures its engagement to the insulator 60 and the induction coil 24 securely fastened directly to the insulator 60.

The insulator 60 is preferably formed of a material sufficient for providing insulating qualities to the induction coil module securing apparatus 10. For example, the insulator 60 may be formed of a non-conducting substance. In one presently preferred embodiment of the present invention, the insulator 60 may also be formed having an irregular octagon configuration. It will be appreciated, however, that although the insulator of the present invention is illustrated in connection with a general octagon configuration, those skilled in the art will recognize that various other geometrical configurations are likewise suitable. The use of a general octagon configuration is thus by way of illustration only and not by way of limitation.

Formed at a second end 64 of the insulator 60 is a receiving hole 68 having an internal periphery for receiving a fastener 70 (e.g., bolt, screw, rivet, etc.) which extends substantially outward in rigid relationship to an induction coil 24. In one presently preferred embodiment, the fastener 70 is threadably introduced within the internal periphery of the receiving hole 68 to facilitate an engagement between the insulator 60 which is suspended in relation to the flexible connector 16 and an induction coil 24.

The induction coils 24 are preferably formed of a substantially sturdy, rigid material sufficient for obtaining intermittent high voltage. For example, the induction coils 24 of the present invention are preferably formed of a heavy copper tubing which is structurally strong enough to maintain its shape when suspended within the furnace housing 12 by the support assembly 11 and the flexible connectors 16. In one presently preferred embodiment of the present invention, the induction coils 24 are formed having a substantially rectangular configuration wherein defining an internal channel or passage 25 for circulating cooling water therethrough. It will be readily appreciated, however, that other shapes or configurations of the induction coils 24 are possible.

While only two induction coil modules are shown in FIGS. 1 and 2 for illustration purposes, an induction furnace for heating steel may comprise between about six and ten coil modules supported in relation to a furnace housing 12. In one presently preferred embodiment of the present invention, seven induction coils modules may be disposed in line within a single induction furnace.

One presently preferred method for reducing structural failure and stress fracturing of the various mechanical connectors which structurally suspend the induction coils 24 within an induction coil module in an induction furnace involves the step of replacing the rigid fasteners 88 used for connecting the induction coils 86 to the support bar 84, as illustrated in FIG. 1, with flexible connectors 16. Each flexible connector 16 including a length of flexible cable 22 securely disposed between a support bar 14 and an induction coil 24. This novel engagement between the support assembly 11 and the flexible connectors 16 facilitates a means for significantly reducing the shear plane and dampening the vibrations caused by the high density electromagnetic field produced by the induction furnace and thus allowing horizontal and vertical movement of the flexible connectors 16 and attached induction coils 24 in relation to a support assembly 11.

It will be apparent that other flexible connection mechanisms disposed between the support assembly 11 and the induction coils 24 may be constructed and disposed in accordance with the inventive principles set forth herein. It is intended, therefore, that the examples provided herein be viewed as exemplary of the principles of the present invention, and not as restrictive to a particular structure for implementing those principles.

From the above discussion, it will be appreciated that the present invention provides novel induction coil module securing apparatus comprising a plurality of flexible connectors pivotably disposed in relation to one or more support bars, each flexible connector having an induction coil attached thereto. In particular, the present invention provides a suspension assembly comprising at least one attachment member pivotably engaging a support bar and a plurality of flexible connectors pivotably disposed in relation to the support bar opposite the attachment member.

Unlike prior art devices, the present invention provides a suspension assembly which facilitates horizontal and vertical movement of the structural connection mechanisms of the present invention (e.g., the flexible connectors and/or pivotably disposed attachment members), thereby significantly reducing the potential of structural fatigue and stress fracturing normally caused as a result of the significant vibrations created within an induction coil module. Additionally, the present invention can be incorporated into various applications in relation to steel rolling processes and the improvement of casting quality and finishing gauges of steel slabs, plates, or ingots. Consistent with the foregoing, the induction coil module securing apparatus of the present invention provides a means for significantly reducing the operational downtime, maintenance, and repair costs generally associated with servicing and rebuilding induction furnaces by way of replacing damaged mechanical connectors.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A suspension assembly for induction coil modules suspended in induction furnaces, said suspension assembly comprising:

a support assembly having, a furnace housing, at least one support bar, and at least one furnace housing attachment member disposed between said furnace housing and the at least one support bar;

a flexible connector comprising a first end, a second end, and a length disposed between said first and second ends;

a first attachment member securely attached to said first end of said flexible connector, said first attachment member pivotably connected to the at least one support bar of said support assembly; and a second attachment member securely attached to said second end of said flexible connector, wherein said second attachment member being suitable for connection to an induction coil.

2. A suspension assembly for induction coil modules as defined in claim 1 wherein said furnace housing attachment member comprises a pivotal engagement between said furnace housing and the at least one support bar.

3. A suspension assembly for induction coil modules as defined in claim 2 wherein said pivotal engagement includes an attachment clevis.

4. A suspension assembly for induction coil modules as defined in claim 1 wherein said length of said flexible connector comprises a flexible cable.

5. A suspension assembly for induction coil modules as defined in claim 1 wherein said first attachment member of said flexible connector comprises a clevis.

6. A suspension assembly for induction coil modules as defined in claim 1 wherein said second attachment member of said flexible connector comprises a threaded rod.

7. A suspension assembly for induction coil modules as defined in claim 1 further comprising an induction coil in connection with said second attachment member and wherein said induction coil comprises heavy copper tubing.

8. A suspension assembly for induction coil modules as defined in claim 1 further comprising an induction coil in connection with said second attachment member and wherein said induction coil comprises an internal passage for circulating cooling water.

9. A suspension assembly for induction coil modules as defined in claim 1 further comprising an induction coil in connection with said second attachment member and wherein said induction coil comprises an operable connection to a means for generating intermittent high voltage.

10. A suspension assembly for induction coil modules suspended in induction furnaces, said suspension assembly comprising:

a support assembly;

a flexible connector comprising a first end, a second end, and a length disposed between said first and second ends, said length comprising a flexible cable;

a first attachment member securely attached to said first end of said flexible connector, said first attachment member comprising a clevis pivotably disposed in connection with said support assembly; and a second attachment member securely attached to said second end of said flexible connector, wherein said second attachment member comprises a threaded rod suitable for connection with an inductive coil.

11. A suspension assembly for induction coil modules as defined in claim 10 wherein said support assembly comprises a furnace housing, at least one attachment member, and at least one support bar.

12. A suspension assembly for induction coil modules as defined in claim 11 wherein said attachment member comprises a pivotal engagement between said furnace housing and one of said support bars.

13. A suspension assembly for induction coil modules as defined in claim 12 wherein said pivotal engagement includes an attachment clevis.

14. A suspension assembly for induction coil modules as defined in claim 10 further comprising an induction coil in connection with said swedged threaded rod of said second attachment member and wherein said induction coil comprises heavy copper tubing.

15. A suspension assembly for induction coil modules suspended in induction furnaces, said suspension assembly comprising:

a support assembly including a furnace housing, at least one attachment member, and at least one support bar;

said attachment member pivotably disposed between said furnace housing and said support bar;

an induction coil formed of heavy copper tubing;

a flexible connector comprising a first end, a second end, and a length disposed between said first and second ends, said length comprising a flexible cable;

a first attachment member securely attached to said first end of said flexible connector, said first attachment member pivotably connected to said support bar; and a second attachment member securely attached to said second end of said flexible connector, wherein said second attachment member is engageably disposed in connection with said induction coil.

16. A method for reducing structural failure and stress fracturing of various mechanical connectors utilized for suspending induction coils within an induction coil module in an induction furnace, the method comprising the steps of engageably disposing a plurality of flexible connectors between a support assembly and a plurality of induction coils; and pivotably disposing said flexible connectors in relation to said support assembly.

17. The method of claim 16 wherein said flexible connectors comprise a length of flexible cable.

18. The method of claim 16 wherein each of said flexible connectors comprises a first attachment member pivotably connected to said support assembly and a second attachment member securely attached to one of said induction coils.

* * * * *